United States Patent [19]

Svirklys

[11] 4,382,414

[45] May 10, 1983

[54] STEEL PALLET CONSTRUCTION

[76] Inventor: Ferdinand M. Svirklys, 54 Carnforth Rd., Toronto, Ontario, Canada, M4A 2L2

[21] Appl. No.: 32,743

[22] Filed: Apr. 24, 1979

[30] Foreign Application Priority Data

| | | | |
|---|---|---|---|
| Apr. 25, 1978 | [GB] | United Kingdom | 16286/78 |
| Jun. 20, 1978 | [GB] | United Kingdom | 27426/78 |
| Apr. 17, 1979 | [DE] | Fed. Rep. of Germany | 2915460 |

[51] Int. Cl.[2] ..... B65D 19/28

[52] U.S. Cl. ..... 108/56.1; 24/294; 24/295; 52/489; 52/775; 403/406; 403/408

[58] Field of Search ..... 108/56.1, 56.3, 57.1, 108/51.1, 51.3; 52/489, 775; 24/73 B, 73 PP, 73 SM, 73 BC, 85 B; 403/408, 406, 397; 206/386, 596, 599, 600

[56] References Cited

U.S. PATENT DOCUMENTS

| | | | |
|---|---|---|---|
| 2,128,005 | 8/1938 | Lombard | 24/73 PP |
| 2,154,712 | 4/1939 | Van Uum | 52/489 X |
| 2,659,950 | 11/1953 | West | 24/73 BC |
| 2,908,955 | 10/1959 | Brown | 52/489 X |
| 3,094,950 | 6/1963 | Brown | 108/56.1 |
| 3,998,018 | 12/1976 | Hodges | 52/489 X |
| 4,077,334 | 3/1978 | Svirklys | 108/56.1 |

FOREIGN PATENT DOCUMENTS

| | | | |
|---|---|---|---|
| 2648467 | 4/1978 | Fed. Rep. of Germany | 24/73 B |
| 1,402,266 | 5/1965 | France | 24/73 B |
| 1037172 | 7/1966 | United Kingdom | 52/489 |

*Primary Examiner*—William E. Lyddane

[57] ABSTRACT

A steel pallet comprises overlying deck-board panels (14, 116) and transversely directed stringer elements (12, 114). The elements are interconnected through one-piece spring steel clips (46, 112) mounted to the deck-board panels (14, 116) and received through transverse slots (18, 20; 134) in the stringer elements (12, 114).

22 Claims, 10 Drawing Figures

STEEL PALLET CONSTRUCTION

FIELD OF INVENTION

The present invention relates to pallets.

BACKGROUND TO THE INVENTION

Pallets constructed of steel have considerable advantages in that they exhibit substantially constant dimension and substantially constant weight, rendering them of considerable utility in high rise storage systems and automated systems, and have considerable durability and weather resistance.

Steel pallets are non-combustible, in contrast to wood, and are lighter than wood for the same dimensions. Wood is also disadvantageous in that it absorbs moisture and is subject to degradation. Steel is also attractive as a material of construction, in that it is relatively inexpensive when compared with aluminum and plastic.

Despite these inherent advantages, steel pallets have not come into common usage, and those steel pallets that have been marketed have been heavy, cumbersome and time-consuming to produce, the elements being interconnected by welding.

SUMMARY OF INVENTION

The present invention is primarily concerned with a steel pallet construction in which the elements are readily formed by suitable metal forming techniques, preferably roll forming, and may be rapidly interconnected using uniquely-constructed one-piece spring clips. The unique constructional features, however, may be used in other assemblies and with pallets formed of other materials of construction.

DESCRIPTION OF PREFERRED EMBODIMENTS

Figure 1:
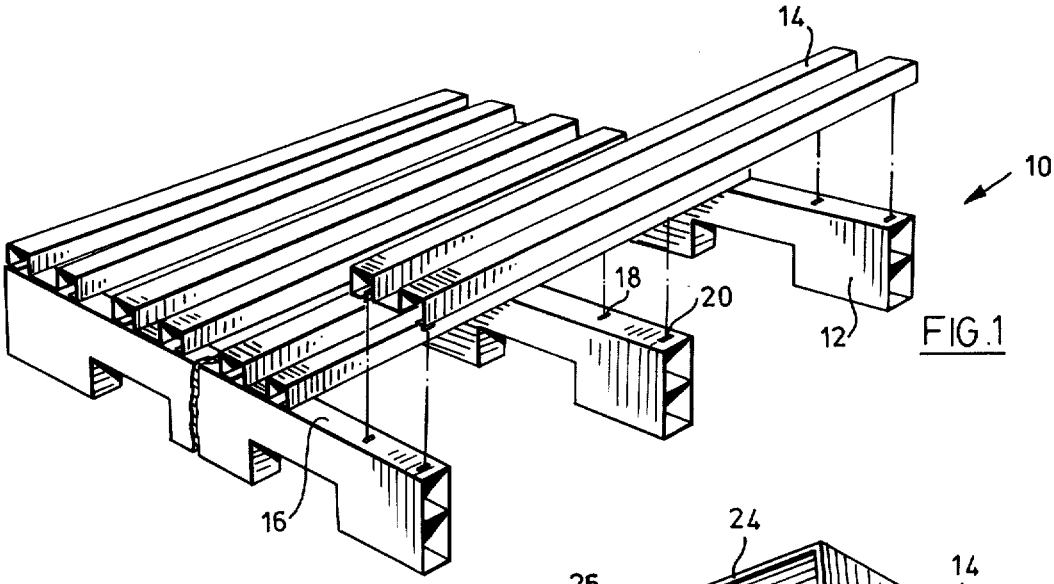
FIG. 1 is a perspective view of a single-deck 4-way steel pallet constructed in accordance with one embodiment of the invention.

Referring first to the embodiment of FIGS. 1 to 4 of the drawings, a pallet 10 constructed of, preferably light gauge, steel, preferably corrosion resistant steel, for example, galvanized steel, includes three elongate hollow members or stringer elements 12 and a plurality of deck-forming elongate roll-formed elements 14 joined to the upper surface 16 of the stringer elements 12 at each intersection thereof and spaced apart in relation to each other and generally perpendicular to the stringer elements 12. The deck-forming elements 14 cooperate to provide a load-carrying deck on the top side of the pallet 10. The stringer elements 12 may be formed by welding together roll-formed parts.

In the illustrated embodiment, a single-deck four-way pallet is shown but it will be clear to those skilled in the art that the principles of construction and the interlocking arrangement may be applied to other pallet forms, including single-deck two-way, double-deck two-way, double-deck four-way and semi-double-deck pallets, and/or to other types of assemblies.

The numbers of stringer elements 12 and deck-board elements 14 in the structure of FIGS. 1 to 4 is also illustravtive and the numbers may be varied as desired, depending on the overall dimensions of the pallet.

In addition, while the illustrated structure of FIGS. 1 to 4 is described particularly with reference to the pallet parts being constructed of light gauge steel by roll-forming, the principles of construction outlined herein may be applied to pallet parts constructed of heavy gauge steel or any other convenient material of construction, such as, aluminum, and may be formed by any other convenient fabrication technique, such as, extrusion.

At each intersection of the stringer elements 12 and a surface or panel of the deck-forming elements 14, the stringer elements 12 are provided with an elongate slot 18 or 20, formed in the upper surface 16 of the stringer element.

The deck-forming elements 14 have a generally castellated structure which includes first and second elongate parallel coplanar elements 22 and 24 which are joined by an integral member defining a channel 26 therebetween and including an elongate portion 28 situated in a plane parallel to the coplanar elements 22 and 24 and adapted to engage the upper surface 16 of the stringer element 12 and first and second upright elements 30 and 32 integrally joining the elongate portion 28 and the coplanar elements 22 and 24.

The deck-forming elements 14 also include integral skirt portions 34 and 36 depending from the coplanar elements 22 and 24 respectively, generally perpendicularly thereto at the sides of the deck-forming members 14 for a distance substantially equal to the depth of the channel 26.

The castellated structure described and illustrated for the deck-forming elements 14 represents a preferred structure for steel parts owing to the ease of roll-forming that structure. However, if desired, the deck-forming elements 14 may have a wholly planar top surface with one or more webs depending therefrom into engagement with the surface 16 of the stringer element 12, such as is described in U.S. Pat. No. 4,077,334.

At the lower end of each skirt portion 34 and 36 are integrally-formed flanges 38 and 40 respectively, the flanges extending the length of the skirt portions and being inwardly-directed coplanarly with the elongate portion 28. The inwardly-directed flanges 38 and 40 define panels for engagement with the upper surface 16 of the stringer element 12.

At each intersection with a stringer element 12, the panels defined by flanges 38 and 40 are provided with an elongate slot 42 and a parallel cut-away notch 44. As described in more detail below, the parallel cut-away notch 44 may be replaced by a second parallel elongate slot or the slot 42 may be moved closer to the edge of the flange 38 or 40 and the cut-away notch 44 eliminated. The slot 42 and notch 44 are provided to receive portions of a unitary clip element 46 for the purpose of mounting the same on the deck-forming element 14.

Figure 3:
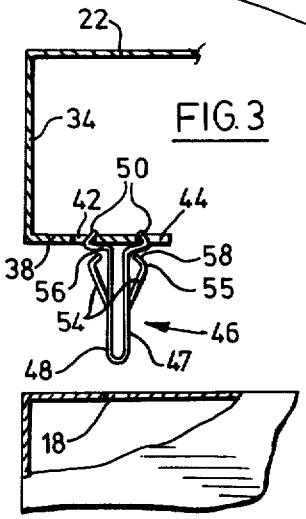
FIG. 3 is a sectional view taken along line III—III of FIG. 2 in a disassembled position.
Figure 4:
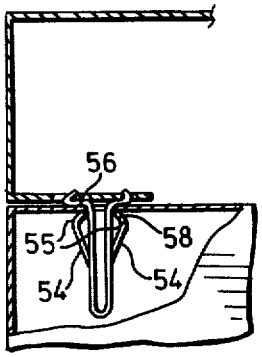
FIG. 4 is the same sectional view as FIG. 3 but in an assembled position.

As may be seen particularly from FIGS. 3 and 4, the clip element 46, constructed of suitable resilient material, preferably spring steel, has a generally U-shaped body 48 and a pair of oppositely-facing jaws 50 located at the upper extremities of the body 48 for gripping the elongate metal strip 52 between the slot 42 and the cut-away notch 44 to hold the clip element 46 to the flange element 38 or 40. The strip 52 is of a substantially constant width.

Figure 2:
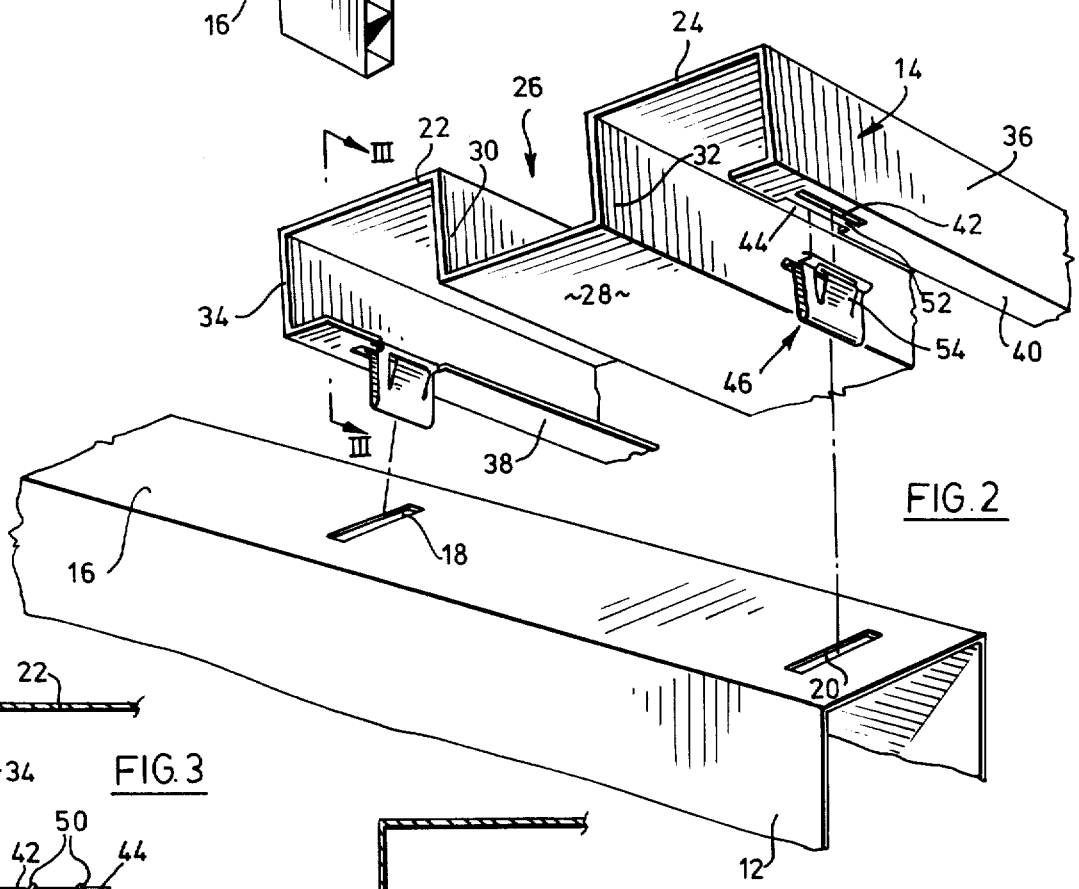
FIG. 2 is a close-up exploded view of the interlocking of the stringer and deck elements of the pallet structure of FIG. 1 along with details of the structure of the interconnecting clips.

Arms 47 of the U-shaped body 48 converge towards the upper end when the clip element is in its rest or non-deformed position as seen in FIG. 2, but are generally parallel to each other when mounted to the flanges 38 and 40 to add to the resiliency of the grip mounting of the clip element 46 on the deck-forming element 14.

The arms of the U-shaped body 48 are each provided with a cantilevered wing element, or ramp element, 54 which diverges outwardly from the contour of the respective body arm 47 in the direction away from the U-bend or bight portion of the body 48 and then turns inwardly from a shoulder 55 at an outer extremity towards the jaw flange 50.

The distance between the shoulder 55 of the ramp element 54 and the lower surface 56 of the lower flange of the jaw element 50 is preferably somewhat greater than the thickness of the upper surface 16 of the stringer element 12. The distance between the free end of the ramp element 54 and the surface 56 is somewhat less than the thickness of the upper surface 16 of the stringer element 12.

As may be seen from comparison of FIGS. 3 and 4, assembly of the stringer element 12 and the deck-forming element 14 at each intersection of the pallet is achieved by inserting the lower U-bend or bight portion of the body member 48 of the clip member 46 into the respective elongate opening 18 or 20 in the stringer element 12, and pushing the deck-forming element 14 down so that the side edges of the opening 18 or 20 engage the wing or ramp elements 54 resiliently forcing them inwardly towards the remainder of the body member 48 until the side edges of the opening 18 or 20 clear the shoulder portion of the ramp element 54, which then resiliently snaps back towards its original position (see FIG. 4) preventing removal of the clip member 46 from the respective opening 18 or 20. The wing or ramp member 54 may be provided with a locking tab or the like to permanently mount a stringer element to a deck member.

The interengagement of the clips 46 with the openings 18 and 20 not only results in a sturdy assembly but also prevents longitudinal movement of the deck-forming elements 14 transverse to the stringer elements 12. Further, the interengagement of the clips 46 with the slots 18 and 20 allows a predetermined degree of resilient freedom of the deck element relative to the stringer element 12 in the direction of the axis of the stringer elements 12 but prevents such movement beyond the point when the side walls of the slots 18 or 20 engage the body portion 48 of the clip 46.

This arrangement arises since, as may be seen in FIG. 4, the transverse distance between the side walls 47 of the clip 46, when the clip 46 is assembled to the deck member 14, is substantially fixed while the transverse distance between the shoulders 55 of the ramp elements 54 is relatively resilient. Preferably, the width of the slot 18 or 20 is greater than the distance between the side walls 47 but less than the distance between the shoulders 55. The deck element 14 thereby is able to move transversely relative to stringer 12 with a certain degree of resilient freedom until the side edges of slot 18 or 20 engage the respective side wall 47 of the clip 46, at which point further transverse movement is prevented. More preferably, the slot 18 or 20 is only marginally wider than the distance between the side walls 47 so that the side walls 47 engage the slot edges and thereby contribute to overall rigidity.

This assembly is superior to other assemblies in which panels are joined together since the deck elements 14 have a limited degree of resilient longitudinal freedom allowing them to resiliently absorb shock loads in that direction to prevent fracturing and damage to the elements while still providing a relatively rigid assembly in both the longitudinal and transverse directions.

As may be seen in FIG. 4, when the stringer element 12 is assembled to the deck element 14 utilizing the clip 46, the upper surface 16 of the stringer element 12 is retained between the inwardly-turned upper portion 58 of the ramp element 54 and the jaw elements of the clip 46.

The flexibility of the pallet structure of FIGS. 1 to 4 permits the pallet structure to absorb vibration and shocks and compensate for minor height and other dimensional variations within the pallet elements and the location of positioning of the pallets. These abilities contrast markedly with the very rigid structure of welded units, which are not able readily to absorb vibration and compensate for the dimensional and positioning variations.

In addition, the use of the mechanical interlock arrangement between the deck elements 14 and the stringer elements 12 utilizing the clips 46 permits ready replacement of damaged parts, which is not the case in welded structures.

Figure 5:
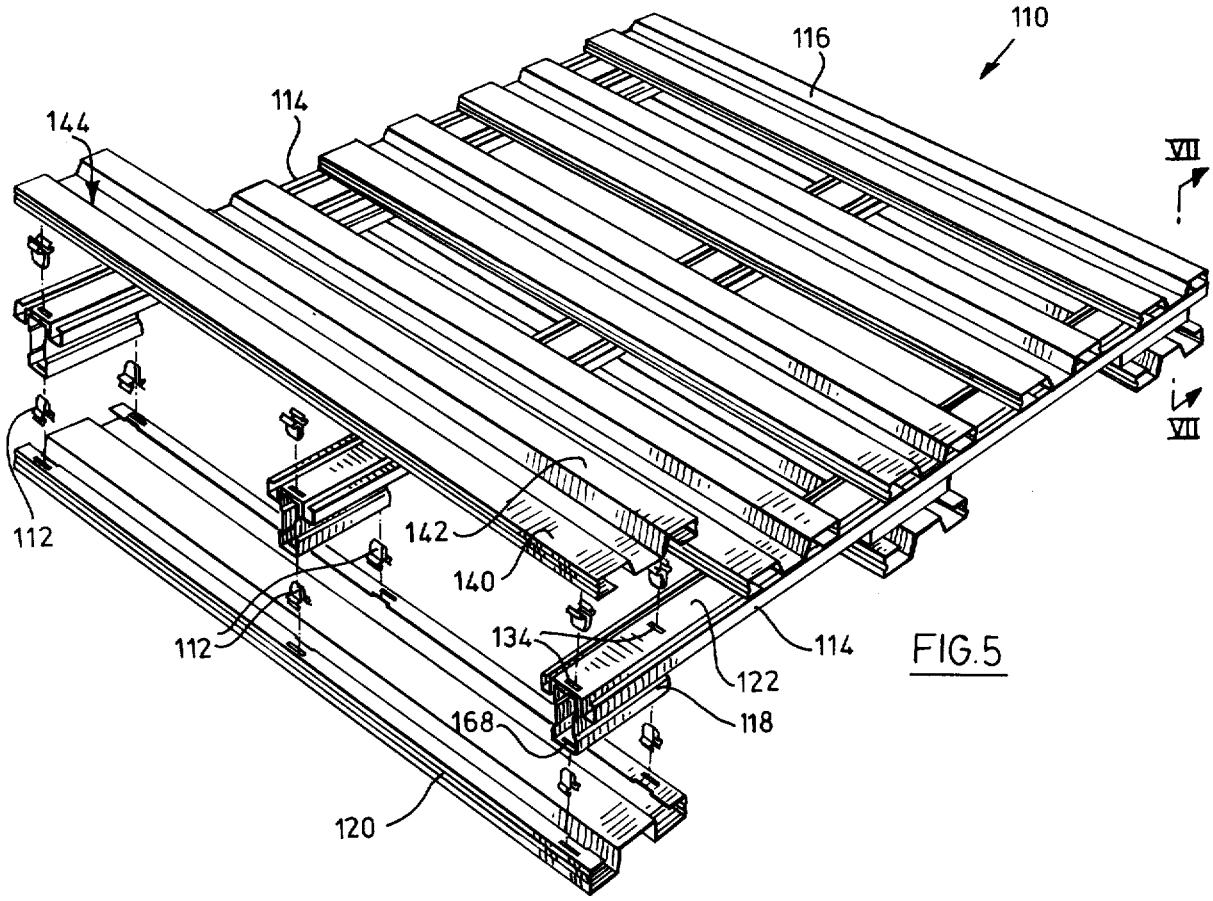
FIG. 5 is a perspective view of a double-deck 4-way steel pallet constructed in accordance with a second embodiment of the invention.
Figure 6:
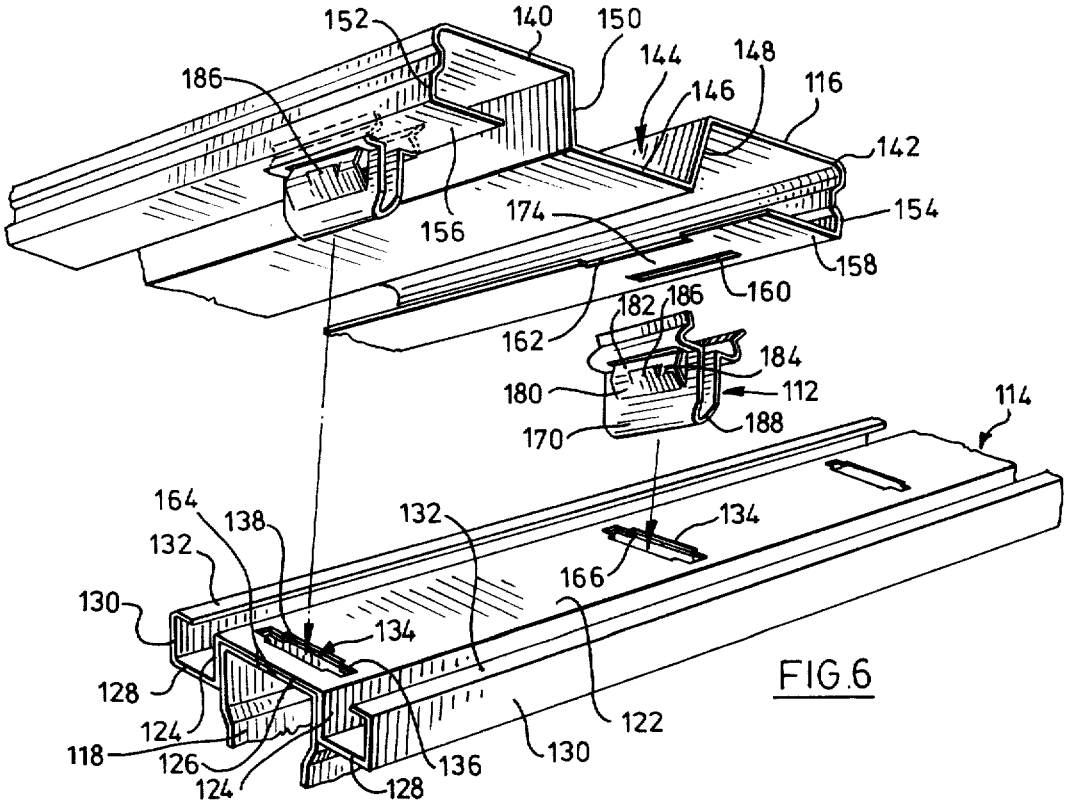
FIG. 6 is a close-up detail view of the interlocking of the elements of the pallet structure of FIG. 5 along with details of the structure of the interlocking clips.
Figure 7:
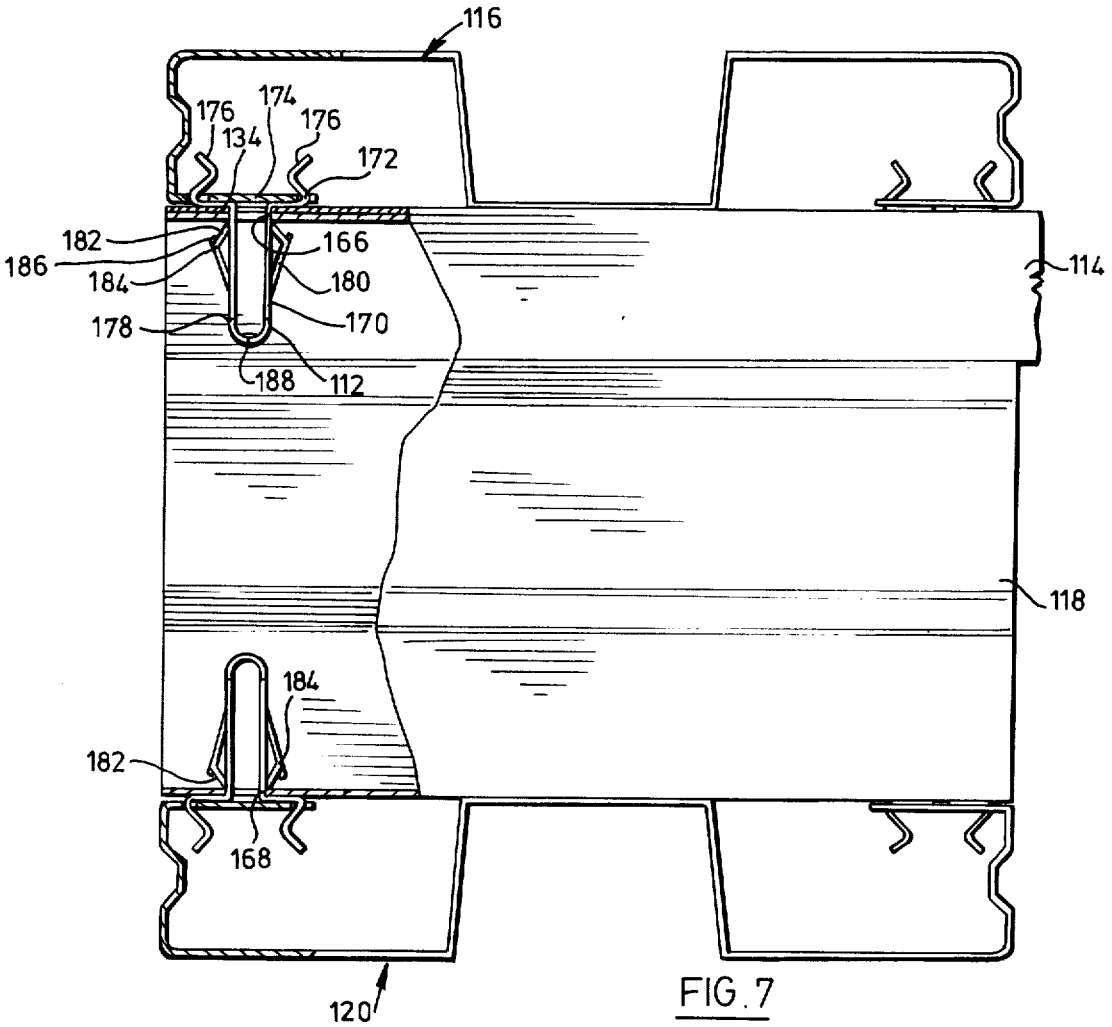
FIG. 7 is a partial sectional view of the assembled pallet taken along line VII-13 VII of FIG. 5.

Turning now to the embodiment of FIGS. 5 to 7, there is illustrated therein a steel pallet 110 of modified construction with respect to the pallet 10 of FIGS. 1 to 4 and utilizing a modified form of clip 112 when compared with the clips 46. The structure of the clips 112 is illustrated in detail in FIGS. 8 to 10

The pallet 110, constructed preferably of light gauge steel, more preferably corrosion resistant steel, for example, galvanized steel, includes three roll-formed elongate spaced stringer elements 114, a plurality of elongate roll-formed top deck-board elements 116 located in spaced apart relation with each other and extending transversely of the stringer elements, three spaced roll-formed hollow leg elements 118 depending from the stringer elements 114 and three elongate roll-formed bottom deck-board elements 120 connected to the lower ends of the leg elements 118.

The pallet construction 110 of FIGS. 5 to 7 differs from that of FIGS. 1 to 4 in that the welding operations and their time-consuming character required for construction of the stringer elements 12 of the pallet 10 are eliminated. In the pallet 110, the component parts are held together by clips 112.

In the illustrated embodiment, a double-deck four-way pallet is shown but it will be clear to those skilled in the art that the principles of construction and the interlocking arrangement may be applied to other pallet forms, including single-deck four-way, single-deck two-way and double-deck two-way, as well as other types of assemblies.

The numbers of stringer elements 114, deck-board elements 116 and 120 and hollow leg elements 118 illustrated in FIGS. 5 to 7 are used to illustrate the principles of construction of the pallet 110. Any desired number of such elements may be used, depending on the size and intended use of the pallet.

While the illustrated structure of FIGS. 5 to 7 is described particularly with reference to the pallet parts being constructed of light gauge steel by roll-forming, the principles of construction outlined herein may be applied to pallet parts constructed of heavy gauge steel or other convenient material of construction, such as, aluminum, and may be formed by any other convenient fabrication technique, such as, extrusion.

The stringer elements 114 are elongate members having an elongate planar panel portion 122 receiving the deck-boards 116 thereon and integral depending side wall or skirt portions 124 defining with the underside of the panel portion 122 a leg receiving channel 126. The side wall portions terminate in integral outwardly-directed perpendicular wall portions 128 which themselves terminate in integral upwardly-directed perpendicular wall portions 130 extending parallel to and for the height of the skirt portions 124, the wall portions 130 terminating in integral inwardly-directed flange portions 132 which provide additional bearing surfaces for the deck-forming elements 116. The arrangement of integral wall portions 124, 128 and 130 and flange 132 define generally rectangularly-shaped elongate channels at each side of the planar panel portion 122.

At each intersection of the stringer elements 114 and panel-like engaging portions of upper deck-forming elements 116, the stringer elements 114 are provided with transverse elongate slots 134, formed through the panel portion 122. The slots 134 have a narrower portion 136 adjacent the longitudinal ends thereof and a wider portion 138 extending between the narrower portions 136. The purpose of this construction will become apparent below.

Both the upper deck-board elements 116 and the lower deck-board elements 120 have the same structure although used in opposite orientations. The structure of these elements will be described with respect to the upper deck-board elements 116. The upper deck-board elements 116 have a generally castellated cross-section which includes first and second elongate coplanar elements 140 and 142 which are joined by an integral member defining a channel 144 and including an elongate portion 146 situated in a plane parallel to the coplanar elements 140 and 142 to engage the upper surface of the planar portion 122 and the flange portions 132 of the stringer 114.

The deck-board elements 116 further include first and second upright elements 148 and 150 integrally joining the elongate portion 146 and the coplanar portions 140 and 142. Integral skirt portions 152 and 154 depend from the coplanar elements 140 and 142 respectively, generally perpendicularly thereto at the sides of the boards 116, for a distance substantially equal to the depth of the channel 144. The skirt portions 152 and 154 are each provided with an indented elongate groove extending the length thereof to impart strength to the deck-board elements 116.

At the lower end of the skirt portions 152 and 154 are integrally-formed inwardly-directed flanges 156 and 158, respectively, which extend the length of the skirt portions and extend coplanarly with the elongate portion 146. The inwardly-directed flanges 156 and 158 define panels for engagement with the planar portions 122 and the flanges 132 of the stringer elements 114.

At each intersection of an upper deck-board element or member 116 with a stringer element 114, the panels defined by the flanges 156 and 158 are provided with an elongate slot 160 and a parallel cut-away notch 162. The parallel cut-away notch 162 may be replaced by a second parallel elongate slot or the slot 160 may be moved closer to the edge of the flange 156 or 158 and the cut-away notch 162 eliminated. The slot 160 and notch 162 are provided to receive portions of the unitary clip structure 112 for the purposes of mounting the same on the deck-forming element 116 (or 120).

Each leg element 118 consists of a generally rectangularly cross-sectioned member having its longer dimension vertical and is roll-formed from a single metal piece so that the ends 164 of the metal piece are very closely located to each other, and preferably in abutting relationship. The side walls of the leg element 118 are waisted to impart structural strength thereto. The leg elements 118 are received in abutting interference fit relationship with the channel 126 formed by the stringer elements 114, with the ends 164 being prevented from opening by entrapment in the channel 126.

Slots 166 of the same shape and form as and aligned with slots 134 are provided in the portion of the leg element 118 abutting the underside of the panel portion 122 to receive the clips 112 therethrough. Slots 168 are provided in the lower surface of the leg element 118 of the same shape and form as slots 166 to receive therethrough the clips 112 mounted on lower deck-board elements 120 to assemble the lower deck-board elements 120 with the remainder of the pallet.

Where a single deck pallet is required, the latter slots may be omitted. Where a two-way pallet is required, the spaced leg elements 118 may be provided as a continuous leg element extending from one extremity of the stringer element 114 to the other.

Figure 8:
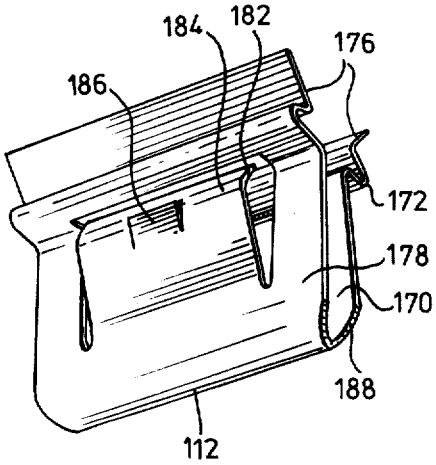
FIGS. 8, 9 and 10 are respectively perspective, elevation and end views of the clips used in the pallet structure of FIGS. 5 to 7.
Figure 9:
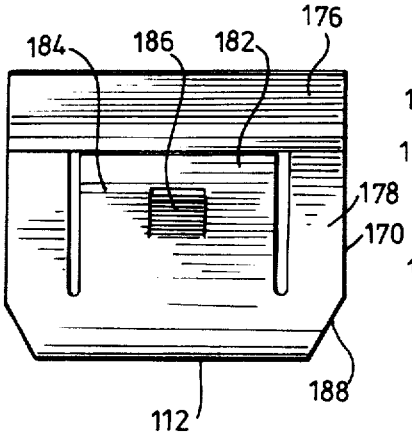
Figure 10:
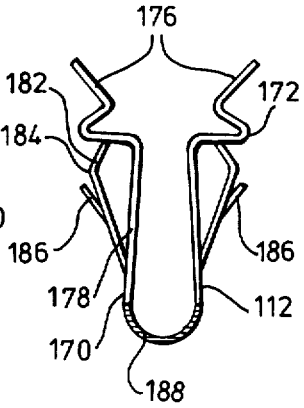

As may be particularly seen, particularly from FIGS. 8 to 10, each clip 112, constructed of suitable resilient material, preferably spring steel, has a generally U-shaped body 170 and a pair of oppositely facing jaws 172 located at the upper extremities of the body 170 for gripping the elongate metal strip 174 of substantially constant width located between the slot 160 and the cut-away notch 162 to hold the clip element 112 to the flange 156 or 158.

The jaw elements 172 also include integral diverging wing members 176 to facilitate assembly of the clip element 112 to the deck board elements 116 or 120. The arms 178 of the U-shaped body 170 converge slightly towards the jaw element end thereof when the clip element 112 is in its rest or non-deformed position (see FIG. 10) but are generally parallel to each other when mounted to the flanges 156 and 158 to add to the resiliency of the grip mounting of the clip element 112 on the deck-board 116 or 120, as may be in FIG. 7.

The arms 178 of the U-shaped body 170 are each provided with a cantilevered wing element, or ramp element 180 a transverse dimension substantially the length of the wider portion 138 of the slot 134. The ramp element 180 diverges outwardly from the contour of the respective body arm 178 in the direction away from the U-bend or bight portion of the body 170 and then has an inwardly turned portion 182 extending from a shoulder 184 towards the adjacent jaw 172 to terminate in planar alignment with the lower surface of the jaw 172, as may be seen from FIGS. 8 and 10. The shoulders 184 are spaced apart a distance greater than the transverse dimension of the slot 134. A locking tab 186 is provided extending oppositely from the portion 182 for a short distance towards the adjacent jaw 172.

The body portion 170 has cut-aways 188 at each longitudinal extremity adjacent the bight portion thereof to assist in location and assembly of the pallet elements. Such cut-aways may be omitted, if desired.

The clip 112 is mounted to the deck-board member 116 or 120 by engaging the wing members 176 with the slot 160 and notch 162 and pushing the clip 112 towards the flange element 156 or 158 to spread the jaw elements 172 apart until the sides of the metal strip 174 pass the shoulder defined by the jaw elements 172 and the wing elements 176, whereupon the jaws 172 of the clip 112 snap into resilient engagement with the opposite sides of the metal strip 174.

Assembly of the deck-board members 116 and 120 with clips 112 attached thereto with the remainder of the pallet is initiated by locating, with the assistance of the cut-aways 188, the U-bend or bight portion of the clip 112 in the respective aligned elongate slot 134 and 166 of the stringer element 114 and the leg element 118 respectively, for the upper deck-board members 116 or into the respective openings 168 in the leg element 118 for the lower deck-board members 120. The deck-board member 116 or 120 is then pushed towards the respective slots, so that the side edges of the wider portions 138 of the respective slots engage the wing or ramp elements 180 resiliently forcing them inwardly towards the remainder of the body member 170 until the side edges of the openings clear the shoulders 184. The ramp elements 180 then resiliently snap back towards the original position to prevent removal of the clip member 112 from the respective slot. In this assembled position, the inwardly-turned portions 182 extend into engagement with the side edges of the wider portion 138 of the slots while the remainder of the transverse length of the body portion 178 engages the narrow portion 136 of the slots. The locking tabs 186 result in a substantially permanent assembly.

As seen in FIG. 7, the clips 112 assemble the upper deck-board member 116 with the stringer element 114 and the leg member 118. The clips 112 also assemble the lower deck-boards 120 with the leg member 118. The clips 112 used in the pallet structure of FIGS. 5 to 7, impart rigidity and limited resiliency characteristics to the pallet 110 similar to those imparted by the clips 46 in the pallet 10 of FIGS. 1 to 4 and discussed in more detail above with respect thereto.

The clips 112 differ from clips 46, however, in important and beneficial respects. Thus, the clips 112 have divergent wing flanges or elements 176 to permit more ready and rapid mounting of the clips 112 on the deck-board members 116 and 120 than is the case with the clips 46. Further, the inwardly-directed portions 182 of the ramp elements 180 extend further inwardly than is the case for clips 46 so as to engage the slot walls. This ramp element structure permits both the multiple metal thicknesses associated with assembly of the upper deck-boards 116 with the stringer elements 114 and the leg elements 118 and the lesser metal thickness associated with assembly of the lower deck-boards 120 with the leg elements 118 to be accommodated, which is not the case with clip 46.

SUMMARY OF INVENTION

In summary of this disclosure, the present invention provides steel pallet structures, clip structures for utilization therewith, and assemblies of parts applicable in other devices. Modifications are possible within the scope of the invention.

What we claim is:

1. A pallet construction, comprising:

at least two spaced-apart substantially parallel longitudinally-extending members, a plurality of deck-forming members contacting and extending at least between the at least two longitudinally-extending members generally transverse thereto in spaced-apart relation, each of said plurality of deck-forming members having at least one planar portion cooperating with the at least one planar portion of others of said plurality of deck-forming members to provide a planar pallet deck surface which extends substantially the length of said longitudinally-extending members, and interconnecting means interconnecting said at least two-longitudinally-extending members with each of said plurality of deck-forming members at the intersections thereof and preventing movement of each of said plurality of deck-forming members longitudinally thereof and transverse to said at least two longitudinally-extending members, at each said intersection, said interconnecting means including clip-receiving slot means formed in said longitudinally-extending member and a one-piece spring metal clip mounted to said deck-forming member and extending into said slot means in relative movement-inhibiting relationship therewith, said clip comprising:

a generally U-shaped body taken in cross-section at either end thereof, said body being of a length generally equal to the length of said slot means, said body being defined by a pair of side walls joined by a bight portion at one end thereof and each having an outwardly-extending flange which is turned inwardly at the free end thereof to define a pair of inwardly-facing jaw members extending from the other ends thereof, said jaw members being separated by a distance less than the width of a mounting strip provided on said deck-forming member in a non-resiliently-deformed position of the clip, said body member including a cantilevered ramp member formed from each of the side walls and spaced inwardly from the ends of the side walls, said ramp members including a first portion extending outwardly from said bight portion to a shoulder and a second portion extending inwardly from said shoulder towards said flanges, when said jaws are separated by a distance equal to the width of said strip, the distance between said sidewalls being less than the width of the slot and the distance between said shoulders being greater than the width of said slot.

2. The pallet construction of claim 1 including three of said longitudinally-extending members constructed identically and substantially equally spaced from each other, and wherein each of said plurality of deck-forming members is constructed identically and extends between the outer ones of the three longitudinally-extending members and terminates either flush with the outer edge or overhangs the outer edges.

3. The pallet structure of claim 1 wherein said jaw members have outwardly-diverging wing members extending from the free end of the inwardly-turned flange portion in the opposite direction to said body.

4. The pallet structure of claim 1 or 3 wherein at least one of said ramps includes a locking tab formed therefrom, said locking tab being cantilevered from said ramp and extending outwardly from said first portion beyond said shoulder.

5. The pallet structure of claim 1 or 3 wherein said outwardly-extending flanges of said clips are coplanar and said second portion of said ramp members terminate in substantially the plane of said outwardly-extending flanges.

6. The pallet structure of claim 1 wherein said side walls converge inwardly towards said flanges in the non-deformed condition of said clip and are generally parallel when said jaws are assembled with said deck-forming members.

7. A pallet construction, comprising:

three substantially equally spaced-apart parallel longitudinally-extending members each comprised of a continuous elongate planar portion extending the length thereof and three hollow portions of generally rectangular cross-section with the longer dimension thereof located upright, said hollow portions being located one at each end of the planar portion and the other approximately midway in the length thereof, a plurality of deck-forming members contacting and extending at least between the three longitudinally-extending members generally transverse thereto in spaced-apart relation, each member of said plurality of deck-forming members includes first and second coplanar portions spaced from the continuous planar portion of said longitudinally-extending member at each intersection thereof, a third planar portion engaging said continuous planar portion of said longitudinally-extending member at each intersection and extending in parallel relation to said first and second coplanar portions, first and second wall portions integrally joining the sides of the third planar portion to the respective inner sides of the coplanar portions, first and second skirt portions integrally joined to the outer sides of the coplanar portions and extending a distance substantially equal to the height of the wall portions, first and second flanges integrally joined to the respective lower end of said first and second skirt portions and extending inwardly therefrom towards said third planar portion in parallel relation therewith and in engagement with said continuous planar portion of said longitudinally-extending member, each of said coplanar portions of said plurality of deck-forming members cooperating with others of said coplanar portion to provide a planar pallet deck surface which extends substantially the length of said longitudinally-extending members, each of said flange portions adjacent each said intersection of a deck-forming member and a longitudinally-extending member having a first slot formed therein having a first edge parallel to and spaced from an edge of said flange portion to define an elongated strip of substantially constant width between said first edge and said second-mentioned edge, said continuous elongate planar portion at each intersection thereof with one of said plurality of deck-forming members having a first pair of elongate slots formed therethrough in respective alignment with and having the same elongate dimension as the elongate strip of one of said flanges, each said hollow portion having a second pair of slots formed therethrough in alignment with and dimensioned the same as said first pair of slots, and a plurality of one piece stamped spring steel clip members assembling the deck-forming members to the longitudinally-extending members at each said intersection thereof, each clip member comprising a generally U-shaped body portion taken in cross-section at either end thereof, said body being of a length generally equal to the length of said pairs of slots, said body being defined by a pair of side walls joined by a bight portion at one end thereof and each having an outwardly-extending flange which is turned inwardly at the free end thereof to define a pair of inwardly facing jaw members extending from the other ends thereof, said jaws being separated by a distance less than the width of said strip in the non-resiliently-deformed position of said clip, said clip member being mounted to said flange members with said strip resiliently retained between said jaws, said clip member includes a cantilevered ramp member formed from each of said side walls and spaced inwardly from the ends of said side walls, said ramp members each including a first portion extending outwardly from said bight portion to a shoulder and a second portion extending inwardly towards said flanges, said body extending through said first pair of slots and through any aligned second pair of slots with the longitudinally-extending members being retained between said jaw members and said second portions of said ramp members, the distance between said side walls being less than the minimum width of said first and second pairs of slots and the distance between said shoulders being greater than the maximum width of said first and second pairs of slots in said assembled position.

8. The pallet structure of claim 7 wherein said outwardly-extending flanges of said clip members are coplanar and said second portion of said ramp members terminate in substantially the plane of said outwardly-extending flanges.

9. The pallet structure of claim 7 or 8 wherein the free end of each of the inwardly-turned flange portion of said clip member has an outwardly-diverging wing member extending therefrom in the opposite direction to said body portion thereof.

10. The pallet construction of claim 7 wherein said first and second pairs of slots each has a first lateral dimension adjacent each end thereof and a second lateral dimension wider than said first lateral dimension and of a length substantially that of said ramp member, and wherein said second portion of said ramp members extend into engagement with said second lateral dimension portions of said pairs of slots.

11. The pallet structure of claim 7 including a second plurality of said deck-forming members mounted to the said hollow members at the other side thereof from said first plurality of deck-forming members by correspondingly-mounted clip members extending through a third pair of slots formed in each of said hollow members.

12. The pallet structure of claim 7 including integral square cross-sectioned members at each lateral extremity of said continuous elongate members including a downwardly depending flange defining with the adjacent elongate member a shallow hollow member-receiving channel and an inwardly directed flange coplanar with said elongate member.

13. The pallet structure of claim 7, 10, 11 or 12 wherein said deck-forming members, said continuous elongate members and said hollow members are roll-formed from light gauge steel.

14. An assembly comprising two panels joined in overlying relation by a one-piece stamped spring steel clip, the first panel having a first elongated slot of constant width and length, a first width adjacent the ends thereof and a second width at least equal to said first width between said ends, the second panel having at least one second slot having a first edge parallel to and spaced from an edge of said flange portion to define an elongated strip of substantially constant width between said first edge and said second-mentioned edge, said first and second slots being of substantially equal length, said panels being relatively immovable in the direction of the length of the first slot and relatively immovable with a predetermined degree of resilient freedom in the transverse direction, said clip comprising:

a generally U-shaped body taken in cross-section at either end thereof, said body being of a length generally equal to the length of said slots, said body being defined by a pair of side walls joined by a bight portion at one end thereof and each having an outwardly extending flange which is turned inwardly at the free end thereof to define a pair of inwardly facing jaw members extending from the other ends thereof, said jaw members being separated by a distance less than the width of said strip in the non-resiliently-deformed position of said clip, said clip being mounted to said second panel with said strip resiliently retained between said jaws, said body having a cantilevered ramp member formed from each of said side walls and spaced inwardly from the ends of said side walls, said ramp members each including a first portion extending outwardly from said bight portion to a shoulder and a second portion extending inwardly from said shoulder towards said flanges, said first panel being retained between said second portions and said flanges, the distance between said side walls being less than the widths of said first slot and the distance between said shoulders being greater than the widths of said first slot when said strip is resiliently retained between said jaws.

15. The assembly of claim 14 wherein at least one of said ramps includes a locking tab formed therefrom, said locking tab cantilevered frofm said ramp and extending outwardly from said first portion beyond said shoulder.

16. The assembly of claim 14 wherein said second width of said first elongated slot is greater than said first width and said second portions of ramp members extend into engagement with the second width portion of said first elongated slot.

17. The assembly of claim 14, 15 or 16 wherein said jaw members have outwardly-diverging wing members extending from the free end of the inwardly-turned flange portion in the opposite direction to the body.

18. The assembly of claim 14 or 16 wherein said outwardly-extending flanges of said clips are coplanar and said second portion of said ramp members terminate in substantially the plane of said outwardly-extending flanges.

19. A one-piece sheet metal clip for attaching two panels in overlying relation, the first panel having a first elongated slot, the second panel having at least one second slot having a first edge parallel to and spaced from an edge of said second panel to define an elongated strip of substantially constant width between said first edge and said second-mentioned edge, said first and second slots being of substantially equal length, said clip comprising:

a generaly U-shaped body taken in cross-section at either end thereof, said body having a length substantially equal to the length of the slots, said body being defined by a pair of side walls joined by a bight portion at one end thereof and each having an outwardly extending flange which is turned inwardly at the outer end thereof to define a pair of inwardly-facing jaw members extending from the other ends thereof, said outwardly-extending flanges being coplanar, said jaw members being separated by a distance less than the width of said strip in the non-resiliently-deformed position of said clip and having outwardly-diverging wing members extending from the free end of the inwardly-turned flange portion in the opposite direction to said body, said body having a cantilevered ramp member formed from each of said side walls and spaced inwardly from the ends of said side walls, said ramp members each including a first portion extending outwardly from said bight portion to a shoulder and a second portion extending inwardly from said shoulder towards said flanges terminating in substantially the plane of said outwardly-extending flanges, the distance between said shoulders and said flanges being greater than the thickness of said first panel, when said jaws are separated by a distance equal to the width of said strip, the distance between said side walls being less than the width of said first slot and the distance between said shoulders being greater than the width of said first slot.

20. The clip of claim 19 wherein said bight portion of said U-shaped body is cut away adjacent each end for ease of location in said first elongated slot.

21. The clip of claim 19 wherein each of ramp members includes a locking tab formed therefrom, said locking tab being cantilevered from said ramp and extending outwardly from said first portion beyond said shoulder.

22. The clip of claim 19 or 21 wherein said side walls converge inwardly towards said flanges in the non-deformed condition of said clip and are generally parallel when said jaws are assembled with said first panel.

* * * * *